US008099021B2

(12) United States Patent
Okabe et al.

(10) Patent No.: US 8,099,021 B2
(45) Date of Patent: Jan. 17, 2012

(54) IMAGE FORMING APPARATUS

(75) Inventors: Yasushi Okabe, Nagoya (JP); Atsushi Hayakawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1377 days.

(21) Appl. No.: 11/673,182

(22) Filed: Feb. 9, 2007

(65) Prior Publication Data

US 2007/0196130 A1 Aug. 23, 2007

(30) Foreign Application Priority Data

Feb. 17, 2006 (JP) ..... 2006-041511

(51) Int. Cl.
*G03G 15/00* (2006.01)

(52) U.S. Cl. ..... 399/167

(58) Field of Classification Search ..... 399/167
See application file for complete search history.

(56) References Cited

U.S. PATENT DOCUMENTS

2005/0058470 A1 3/2005 Funamoto et al.

FOREIGN PATENT DOCUMENTS

| | | | | |
|---|---|---|---|---|
| JP | 61156160 | A | * | 7/1986 |
| JP | 08-194361 | A | | 7/1996 |
| JP | 9179372 | | | 7/1997 |
| JP | 10186778 | | | 7/1998 |
| JP | 11258966 | | | 9/1999 |
| JP | 2000214654 | A | * | 8/2000 |
| JP | 2001281959 | | | 10/2001 |
| JP | 2002062706 | | | 2/2002 |
| JP | 2002244534 | | | 8/2002 |
| JP | 2004-117386 | A | | 4/2004 |
| JP | 2004219671 | A | * | 8/2004 |
| JP | 2004264525 | | | 9/2004 |
| JP | 2005055692 | | | 3/2005 |
| JP | 2005157098 | | | 6/2005 |
| JP | 2005-181885 | A | | 7/2005 |
| JP | 2005265951 | | | 9/2005 |
| JP | 2006154352 | A | * | 6/2006 |

OTHER PUBLICATIONS

JPO Machine Translation of Tominaga (JP 2004-219671 A).*

* cited by examiner

*Primary Examiner* — David Gray
*Assistant Examiner* — Erika J Villaluna
(74) *Attorney, Agent, or Firm* — Banner & Witcoff, Ltd.

(57) ABSTRACT

An image forming apparatus includes four image carriers, four image carrier gears provided corresponding to the respective image carriers, four transmission gears provided corresponding to the respective image carrier gears and meshed with the respective image carrier gears, and two driving sources each provided corresponding to a pair of the transmission gears being adjacent to each other and driving both of the pair of transmission gears.

15 Claims, 8 Drawing Sheets

( a )

( b )

IMAGE FORMING APPARATUS

CROSS REFERENCE TO RELATED APPLICATION

This application claims priority benefits on the basis of Japanese Patent Application No. 2006-041511 filed on Feb. 17, 2006, the disclosure of which is incorporated herein by reference.

BACKGROUND OF THE INVENTION

1. Field of the Invention

The present invention relates to an image forming apparatus such as a color laser printer.

2. Prior Art

Conventionally, as an electrophotographic laser printer, a tandem color laser printer is known, which includes four photosensitive drums to correspond to toners for four colors: yellow, magenta, cyan, and black.

A tandem color laser printer, which forms the toner image of each color on the corresponding each photosensitive drum at substantially the same time, can form color images as fast as a black and white laser printer can.

For example, in a known tandem color laser printer, one drum drive motor drives four photosensitive drums via a reduction gear, a drum drive gear, and a drum gear (see Japanese Unexamined Patent Publication No. 09-179372, for example).

Alternatively, a tandem color laser printer is known in which four drum drive motors are provided to correspond to four photosensitive drums and each drum drive motor drives each photosensitive drum (see Japanese Unexamined Patent Publication No. 2001-281959, for example).

Alternatively, in a known tandem color laser printer, a Bk motor for driving one photosensitive drum corresponding to black, and a YMC motor for driving three photosensitive drums corresponding to yellow, magenta, and cyan are provided. The Bk motor drives one photosensitive drum corresponding to black and at the same time the YMC motor drives three photosensitive drums corresponding to yellow, magenta, and cyan (see Japanese Unexamined Patent Publication No. 2005-157098, for example).

SUMMARY OF THE INVENTION

In a tandem color laser printer, since four colors of the toner image are overlapped, it is important that the printing errors in the respective colors should be overlapped in order to reduce the color shift. For this reason, it is desirable that the photosensitive drums for the respective colors are driven in the same conditions.

On the other hand, Japanese Unexamined Patent Publication No. 09-179372 discloses a tandem color laser printer in which one drum drive motor drives four photosensitive drums via various gears, thereby increasing the number of gears which are interposed between each of the drum drive motors and each of the photoconductor drums and increasing the transmission errors of the gears accordingly. This leads to greater printing errors. As the number of the gear increased, more space to dispose the gear is required and the apparatus becomes larger.

Further, Japanese Unexamined Patent Publication No. 2001-281959 discloses a tandem color laser printer in which four drum drive motors and four photosensitive drums respectively correspond with each other, thereby reducing the number of gears which are interposed between each of the drum drive motors and each of the photosensitive drums. However, it costs more since four drum drive motors are needed. Further, in the case where a plurality of drum drive motors are provided, the phases of the respective drum drive motors should be in synchronization with each other to drive the photosensitive drum of each color in the same condition. For this reason, four phase detecting sensors are needed to be provided corresponding to four drum drive motors and this leads to further cost increase.

Furthermore, Japanese Unexamined Patent Publication No. 2005-157098 discloses a tandem color laser printer in which a YMC motor drives three photosensitive drum, thereby, again, increasing the number of gears which are interposed between the YMC motor and the three photoconductor drums and increasing the transmission errors of the gears corresponding to the number of gears. This leads to greater printing errors. As the number of gears increased, more space to dispose the gears is required and the apparatus becomes larger.

The purpose of the present invention is to provide an image forming apparatus which can drives four image carriers in such a way that the color shift is reduced with a simple configuration while reducing the costs.

An object of the present invention is to provide an image forming apparatus which comprises four image carriers, four image carrier gears each provided for corresponding to each of the four image carriers, four transmission gears each provided for corresponding to each of the four image carrier gears and each meshed with each of the four image carrier gears, and two driving sources each provided for corresponding to a pair of the transmission gears which are adjacent to each other and drives both of the pair of the transmission gears.

DETAILED DESCRIPTION OF PREFERRED EMBODIMENT

1. Overall Construction of Color Laser Printer

Figure 1:
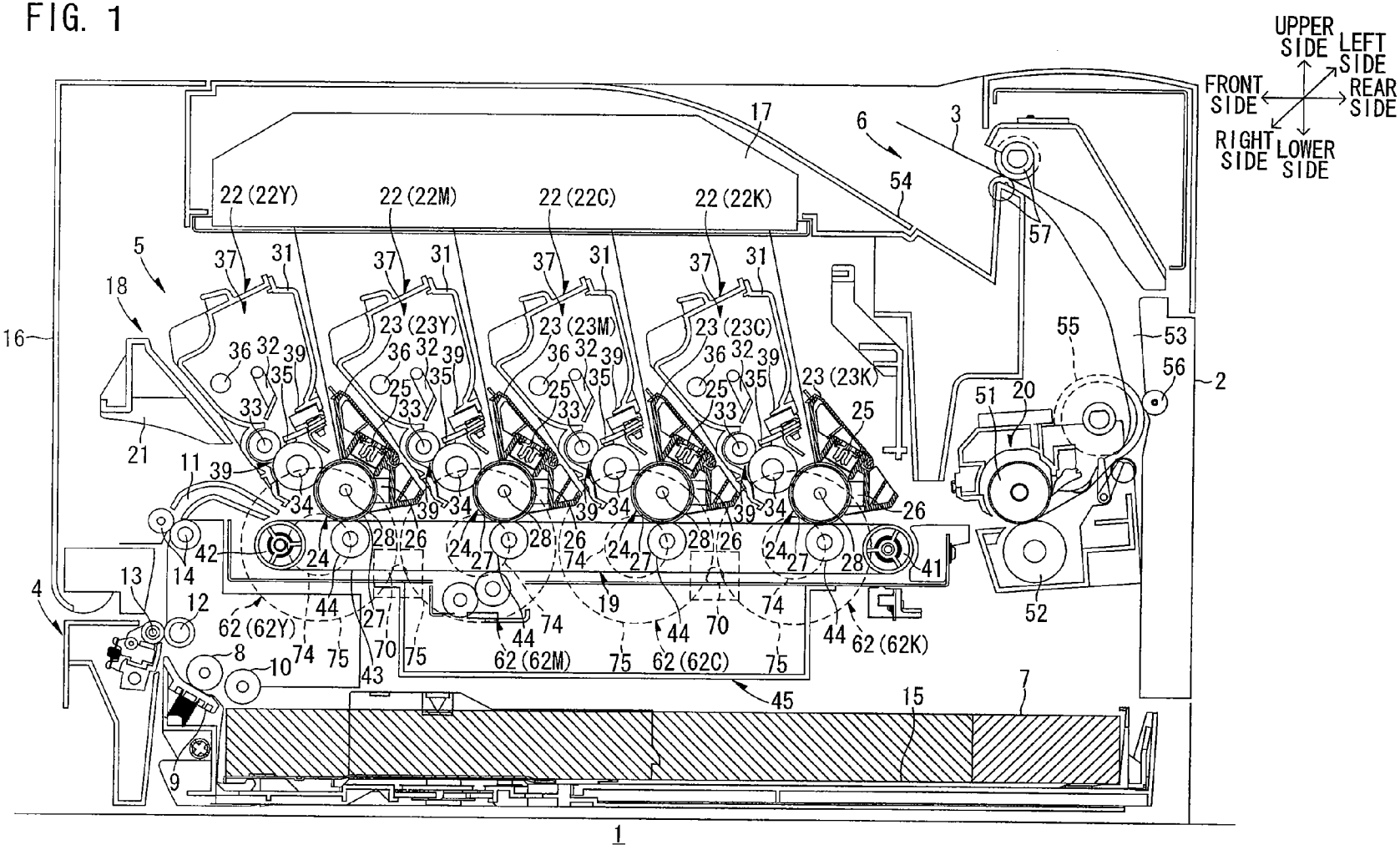
FIG. 1 is a side sectional view illustrating a major portion of a color laser printer as one embodiment according to an image forming apparatus of the present invention.

FIG. 1 is a side sectional view illustrating a major portion of a color laser printer as one embodiment according to an image forming apparatus of the present invention.

The color laser printer 1 shown in FIG. 1 is a transverse type tandem color laser printer in which a plurality of drum subunits 23 are disposed in parallel in horizontal direction. The color laser printer 1 has a main body casing 2 which comprises a sheet feeding section 4 for feeding a sheet 3, an image forming section 5 for forming an image on the fed sheet 3, and a sheet ejecting section 6 for ejecting the sheet 3 on which an image is formed.

On the side wall of the main body casing 2 on one side of the drawing paper, a front cover 16 is provided for opening or closing the main body casing 2. The lower end portion of the front cover 16 is supported swingably on the main body casing 2 via a hinge. The front cover 16 is opened to mount and remove a drum unit 21 to and from the main body casing 2.

In the following description, referring to FIG. 1, the "front side" is used to indicate the left side (the side where the front cover 16 is provided) of the drawing paper of FIG. 1 and the "rear side" is used to indicate the right side of the drawing paper of FIG. 1. Further, the "right side" is used to indicate the front side in a thickness direction of the drawing paper of FIG. 1 and the "left side" is used to indicate the rear side in the thickness direction of the drawing paper of in FIG. 1.

(1) Sheet Feeding Section

A sheet feeding section 4 is provided in the bottom portion of the main body casing 2. The sheet feeding section 4 includes the sheet feed tray 7 accommodating the sheet 3, a separation roller 8 and a separation pad 9 which are provided in opposed relation to each other on an upper front end portion of the sheet feed tray 7, and a sheet feed roller 10 provided at the rear side of the separation roller 8.

In the sheet feeding section 4, a sheet feeding transport path 11 of the sheet 3 is disposed such that the end portion on the upper stream side is adjacent to the separation roller 8 on a lower side thereof and that the end portion on the downstream side is adjacent to the transport belt 43 (described later) on an upper side thereof. The path is formed in a generally U-shape as seen from side view in which the sheet 3 is fed toward the front side and ejected toward the rear side after reversion.

At a point on the sheet feeding transport path 11, a sheet dust removing roller 12 and a pinch roller 13 are provided above the front side of the separation roller 8 in an opposed relation to each other and a pair of resist rollers 14 are provided thereabove.

In the sheet feed tray 7, a sheet pressing plate 15 is provided on which the sheets 3 are stacked and the uppermost sheet 3 on the sheet pressing plate 15 is pressed by the sheet feed roller 10 and fed toward a space between the separation roller 8 and the separation pad 9 by the rotation of the sheet feed roller 10.

The fed sheet 3 is sandwiched between the separation roller 8 and the separation pad 9 and then is separated from the other sheets 3 and fed by the rotation of the separation roller 8. The transported sheet 3 is passed between the sheet dust removing roller 12 and the pinch roller 13 and, after removal of sheet dust, is transported along the sheet feeding transport path 11 toward the resist roller 14.

After registration, the resist roller 14 transports the sheet 3 onto a transport belt 43.

(2) Image Forming Section

An image forming section 5 includes a scanning section 17, a processing section 18, a transferring section 19, and a fixation section 20.

(2-1) Scanning Section

A single scanning section 17 is provided in the upper portion of the main body casing 2 and includes a laser emitting section, a polygonal mirror, a plurality of lens and a reflection mirror which are not shown. In the scanning section 17, laser beams emitted from the laser emitting section on the basis of image data corresponding to respective colors are scanned by the polygonal mirror, passed through or reflected on the plurality of lenses and the reflection mirror, and then irradiated corresponding to respective photosensitive drums 24 and respective colors.

(2-2) Processing Section

The processing section 18 is disposed below the scanning section 17 and above the sheet feeding section 4 and includes a drum unit 21 and four developer cartridges 22 corresponding to respective colors.

(2-2-1) Drum Unit

The drum unit 21 is removably mounted to the main body casing 2 on the front side in an anteroposterior direction when the front cover 16 is opened. The drum unit 21 includes four drum subunits 23 corresponding to respective colors. That is, the drum subunits 23 include a yellow drum subunit 23Y, a magenta drum subunit 23M, a cyan drum subunit 23C, and a black drum subunit 23K.

The drum subunits 23 are disposed in spaced parallel relation in an anteroposterior direction with each other. More specifically, the yellow drum subunit 23Y, the magenta drum subunit 23M, the cyan drum subunit 23C, and the black drum subunit 23K are disposed in this order from the front side to the rear side.

Each of the drum subunits 23 supports a photosensitive drum 24 as an image carrier, a scorotron charger 25, and a cleaning brush 26.

The photosensitive drum 24 includes a drum body 27 of a cylindrical shape provided along a width direction (lateral direction) and having the outermost surface layer formed of a positively chargeable photosensitive layer of polycarbonate, and a drum shaft 28 provided along an axis of rotation (width direction) of the drum body 27. The drum shaft 28 is secured to and supported by the drum subunit 23. The drum body 27 is rotatably supported by the drum shaft 28 through a rotation support member 65 which is described later. A driving force inputted from a motor 61 which serves as a driving source and is described later is transmitted to the photosensitive drum 24 at the time of image formation and rotates the drum body 27, as described later.

The scorotron charger 25 is supported by the drum subunit 23 obliquely rearward above the photosensitive drum 24, and disposed in opposed spaced relation to the photosensitive drum 24. The scorotron charger 25 generates corona discharge at the time of image formation, thereby uniformly positively charging the surface of the photosensitive drum 28.

The cleaning brush 26 is supported by the drum subunit 23 behind the photosensitive drum 24 and disposed in opposed relation to and in contact with the photosensitive drum 24. A cleaning bias is applied to the cleaning brush 26 at the time of image formation.

(2-2-2) Developer Cartridge

Each of the developer cartridges 22 is removably provided corresponding to the drum subunit 23 which corresponds to each color. That is, the developer cartridges 22 include a yellow developer cartridge 22Y which is removably mounted to the yellow drum subunit 23Y, a magenta developer cartridge 22M which is removably mounted to the magenta drum subunit 23M, a cyan developer cartridge 22C which is removably mounted to the cyan drum subunit 23C, and a black developer cartridge 22K which is removably mounted to the black drum subunit 23K.

Each of the developer cartridges 22 includes a developer frame 31, and an agitator 32, a feed roller 33, a developing roller 34 and a layer-thickness regulating blade 35 provided in the developer frame 31.

The developer frame 31 has a box shape opened in the lower end portion. A partition wall 39 formed in the middle portion of the up-and-down direction defines a toner accommodation chamber 37 and a developing chamber 38 such that they communicate with each other.

The toner accommodation chamber 37 contains toner which correspond to each color. More specifically, corresponding to each of the developer cartridges 22, a yellow toner for the yellow developer cartridge 22Y, a magenta toner for the magenta developer cartridge 22M, a cyan toner for the cyan developer cartridge 22C, or a black toner for the black developer cartridge 22K is contained therein, respectively.

As a toner corresponding to each color, a positively chargeable non-magnetic single-component polymerized toner is used, in which colorants of yellow, magenta, cyan, or black is mixed corresponding to each color.

The toner accommodation chamber 37 is provided with a window 36 for detecting the amount of the toner remaining in the toner accommodation chamber 37.

The agitator 32 is provided in the toner accommodation chamber 37. A driving force is transmitted from a motor (not shown) to the agitator 32 to rotate the agitator 32 at the time of image formation.

The feed roller 33 is provided below the partition wall 39 in the developing chamber 38. The feed roller 33 includes a metallic feed roller shaft rotatably supported on the developer frame 31 and a sponge roller formed of an electrically conductive sponge covering the feed roller shaft. A driving force from a motor (not shown) is transmitted to the feed roller 33 at the time of image formation.

The developing roller 34 is provided obliquely rearward below the feed roller 33 in the developing chamber 38. The developing roller 34 includes a metallic developing roller shaft rotatably supported on the developer frame 31, and a rubber roller which is formed of an electrically conductive rubber and covers the developing roller shaft.

The developing roller 34 is disposed with respect to the feed roller 33 such that the rubber roller and the sponge roller press against each other. Further, the developing roller 34 is disposed such that it is exposed from the developer frame 31 downwardly.

A driving force from a motor (not shown) is transmitted to the developing roller 34 and rotates the developing roller 34 at the time of image formation. A developing bias is also applied to the developing roller 34.

In the developing chamber 38, a proximal edge of the layer-thickness regulating blade 35 is supported on the partition wall 39, and a free end portion of the layer-thickness regulating blade 35 is formed of an insulative silicone rubber and presses against the developing roller 34 from above.

(2-2-3) Developing Operation in the Processing Section

In each of the developer cartridges 22, the toner which corresponds to each of the colors accommodated in the toner accommodation chamber 37 is agitated by the agitator 32 and released from the developing chamber 38 by its own weight.

The toner released from the developing chamber 38 is fed to the feed roller 33. The toner fed to the feed roller 33 is then fed to the developing roller 34 by the rotation of the feed roller 33. At this time, the toner is triboelectrically positively charged between the feed roller 33 and the developing roller 34 which is applied with a developing bias.

The toner supplied to the developing roller 34 is introduced between the layer-thickness regulating blade 35 and the developing roller 34 by the rotation of the developing roller 34, whereby the toner is carried in the form of a thin film having a uniform thickness on the surface of the developing roller 34.

On the other hand, in the drum subunit 23 corresponding to each of the developer cartridge 22, the surface of the photosensitive drum 24, after being uniformly positively charged by the scorotron charger 25 with the rotation of the photosensitive drum 24, is exposed to and scanned by the laser beam from the scanning section 17 at a high speed, whereby an electrostatic latent image corresponding to an image to be formed on the sheet 3 is formed on the surface of the photosensitive drum 24.

Then, as the photosensitive drum 24 is rotated, the toner positively charged and carried on the surface of the developing roller 34 is supplied to the electrostatic latent image formed on the surface of the photosensitive drum 24, i.e., to an exposed part of the surface of the uniformly positively charged photosensitive drum 24 having an electrical potential reduced by the exposure with the laser beams, when the toner is disposed in an opposed relation and brought into contact with the photosensitive drum 24 by the rotation of the developing roller 34. Thus, the electrostatic latent image on the photosensitive drum 24 is developed into a visible form, whereby a toner image corresponding to each color is carried on the surface of the photosensitive drum 24 by reversed development.

(2-3) Transferring Section

The transferring section 19 is disposed above the sheet feeding section 4 and below the processing section 18 in the main body casing 2 along an anteroposterior direction. The transferring section 19 includes a drive roller 41, a driven roller 42, a transport belt 43, a transfer roller 44 and a cleaning section 45.

The drive roller 41 and the driven roller 42 are disposed in an opposed spaced relation in an anteroposterior direction. The drive roller 41 is disposed at a rear position of the black drum subunit 23K. The driven roller 42 is disposed at a front position of the yellow drum subunit 23Y.

The transport belt 43 is in the form of an endless belt, and is formed of an electrically conductive resin film such as polycarbonate or polyimide, which is dispersed with electrically conductive particles such as a carbon. The transport belt 43 is wound between the drive roller 41 and the driven roller 42.

A driving force from a motor (not shown) is transmitted to the drive roller 41 and rotates the drive roller 41 at the time of image formation. Accordingly, the transport belt 43 is revolved to rotate in a direction identical to the rotating direction of the photosensitive drum 24 at a transfer position in which the transport belt 43 is in contact with the photosensitive drum 24 of each drum subunit 23 between the drive roller 41 and the driven roller 42, and at the same time, the driven roller 42 is driven.

The transfer rollers 44 are in the transport belt 43 which is wound. Each of the transfer rollers 44 is disposed so as to oppose to each of the photosensitive drums 24 with the transport belt 43 sandwiched therebetween. Each of the transfer rollers 44 includes a metallic roller shaft and a rubber roller which is formed of an electrically conductive rubber and covers the roller shaft.

Each of the transfer rollers 44 is disposed so as to rotate in a direction identical to the revolving direction of the transport belt 43 at a transfer position in which the transfer roller 44 is in contact with the transport belt 43. The transfer roller 44 is applied with a transfer bias at the time of image formation.

The cleaning section 45 is disposed below the transport belt 43 which is wound between the drive roller 41 and the driven roller 42.

The sheet 3 fed from the sheet feeding section 4 is transported so as to sequentially pass the transfer position corresponding to each of the drum subunits 23 from the front side to the rear side by the revolving transport belt 43. During the transportation, the toner image of each color carried by the photosensitive drum 24 of each of the drum subunits 23 is sequentially transferred and forms the color image on the sheet 3.

That is, for example, the yellow toner image carried on the surface of the photosensitive drum 24 of the yellow drum subunit 23Y is transferred onto the sheet 3, and then the magenta toner image carried on the surface of the photosensitive drum 24 of the magenta drum subunit 23M is transferred onto the sheet 3 on which the yellow toner image has already transferred. Further, the operation is repeated in the same manner, and the cyan toner image carried on the surface of the photosensitive drum 24 of the cyan drum subunit 23C and the black toner image carried on the surface of the photosensitive drum 24 of the black drum subunit 23K are also transferred, thereby forming a color image on the sheet 3.

On the other hand, in the aforementioned transfer operation, the toner adhered on the surface of the transport belt 43 is cleaned by the cleaning section 45.

(2-4) Fixing Section

The fixing section 20 is disposed at a rear position of the black drum subunit 23K in the main body casing 2 and is opposed in an anteroposterior direction to a transfer position where the photosensitive drum 24 and the transport belt 43 contact with each other. The fixing section 20 includes a heating roller 51 and a pressure roller 52.

The heating roller 51 is formed of a metal tube with a release layer formed on the surface thereof and includes a halogen lamp along the shaft direction thereof. The surface of the heating roller 51 is heated to a fixed temperature by the halogen lamp.

The pressure roller 52 is disposed in an opposed relation to the heating roller 51 below the heating roller 51. The pressure roller 52 presses the heating roller 51 from below.

The color image transferred onto the sheet 3 is then transported to the fixing section 20, where the color image is thermally fixed during the time when the sheet 3 passes between the heating roller 51 and the pressure roller 52.

(3) Sheet Ejecting Section

In the sheet ejecting section 6, a sheet ejecting transport path 53 of the sheet 3 is disposed such that the end portion on the upper stream side is adjacent to the fixing section 20 at the lower side thereof, and that the end portion on the downstream side is adjacent to a sheet ejection tray 54 at the upper side thereof, and formed in generally U-shape as seen from side view wherein the sheet 3 is fed backward and, after the reversion, rejected toward the front side.

A transport roller 55 and a pinch roller 56 are provided in an opposed relation with each other at a point on the sheet ejection transport path 53. A pair of sheet ejecting rollers 57 is also provided at the end portion on the downstream side of the sheet ejection transport path 53.

A sheet ejection tray 54 is provided at the sheet ejecting section 6. The sheet ejection tray 54 is formed so as to gradually curved downward from the front side to the rear side on the upper wall of the main body casing 2 such that the sheets 3 fed from the tray can be stacked there.

The sheet 3 transported from the fixing section 20 is transported along the sheet ejection transport path 53 by the transport roller 55 and the pinch roller 56 and ejected by the sheet ejecting roller 57 on the sheet ejection tray 54.

2. Construction of Photosensitive Drum Drive System

Figure 2:
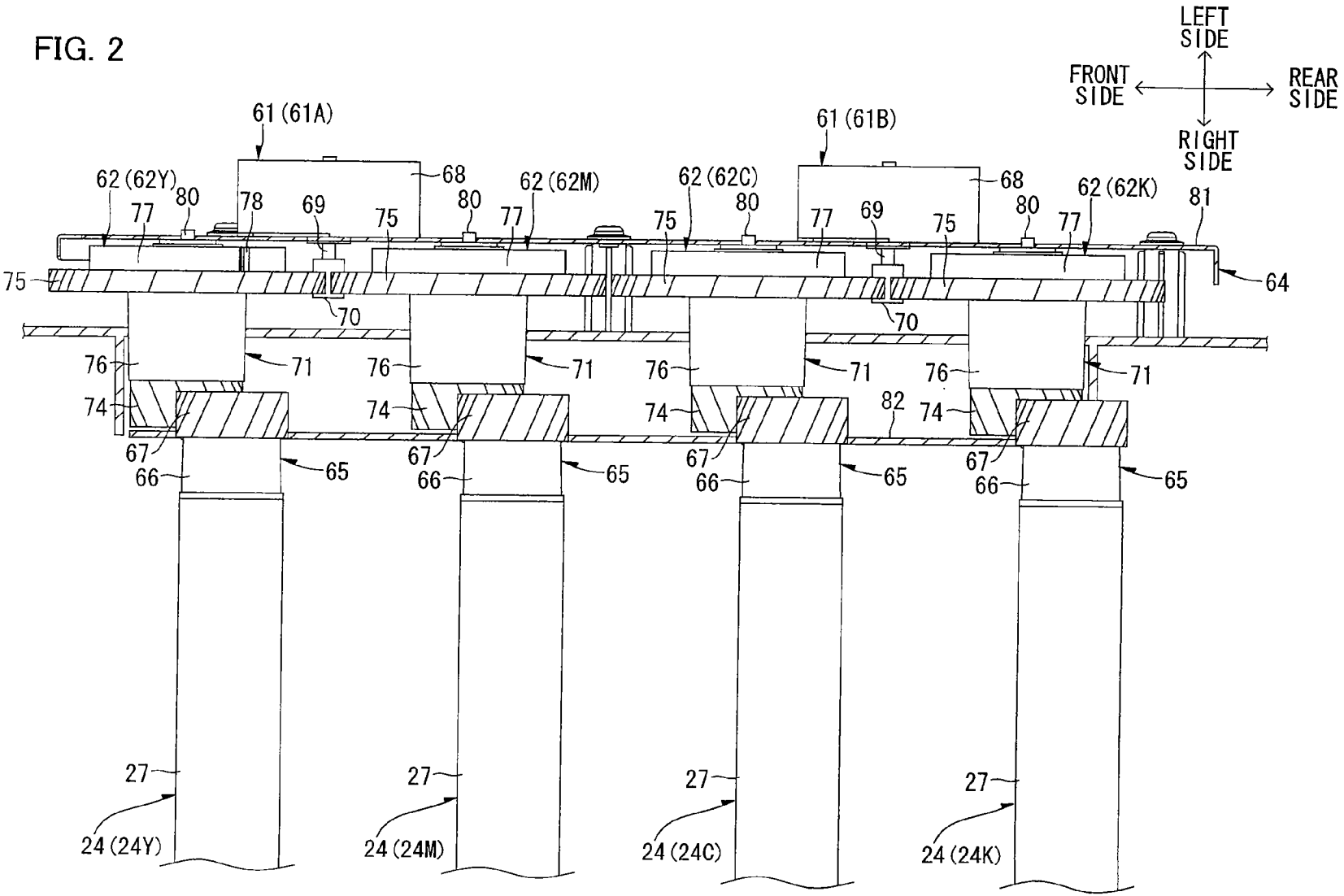
FIG. 2 is a plan view illustrating a major portion of the color laser printer shown in FIG. 1.
Figure 3:
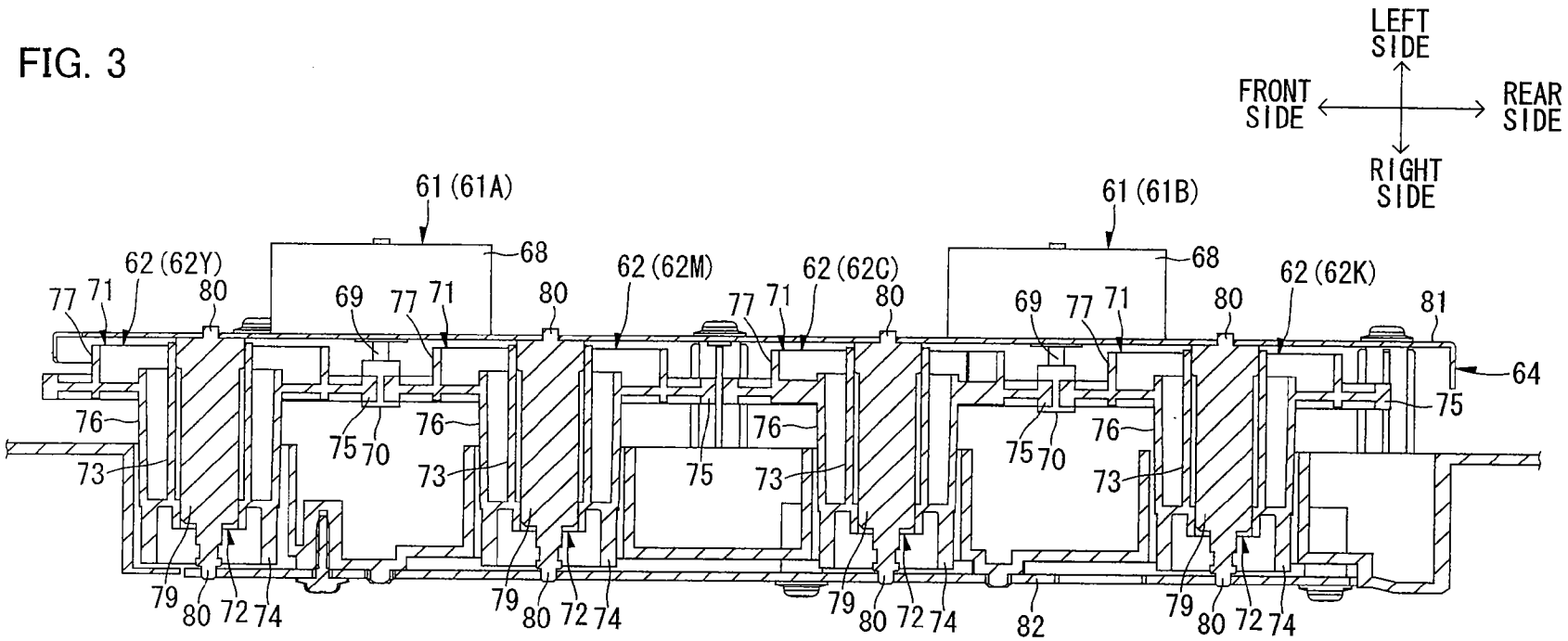
FIG. 3 is a plan sectional view illustrating a major portion according to FIG. 2.
Figure 4:
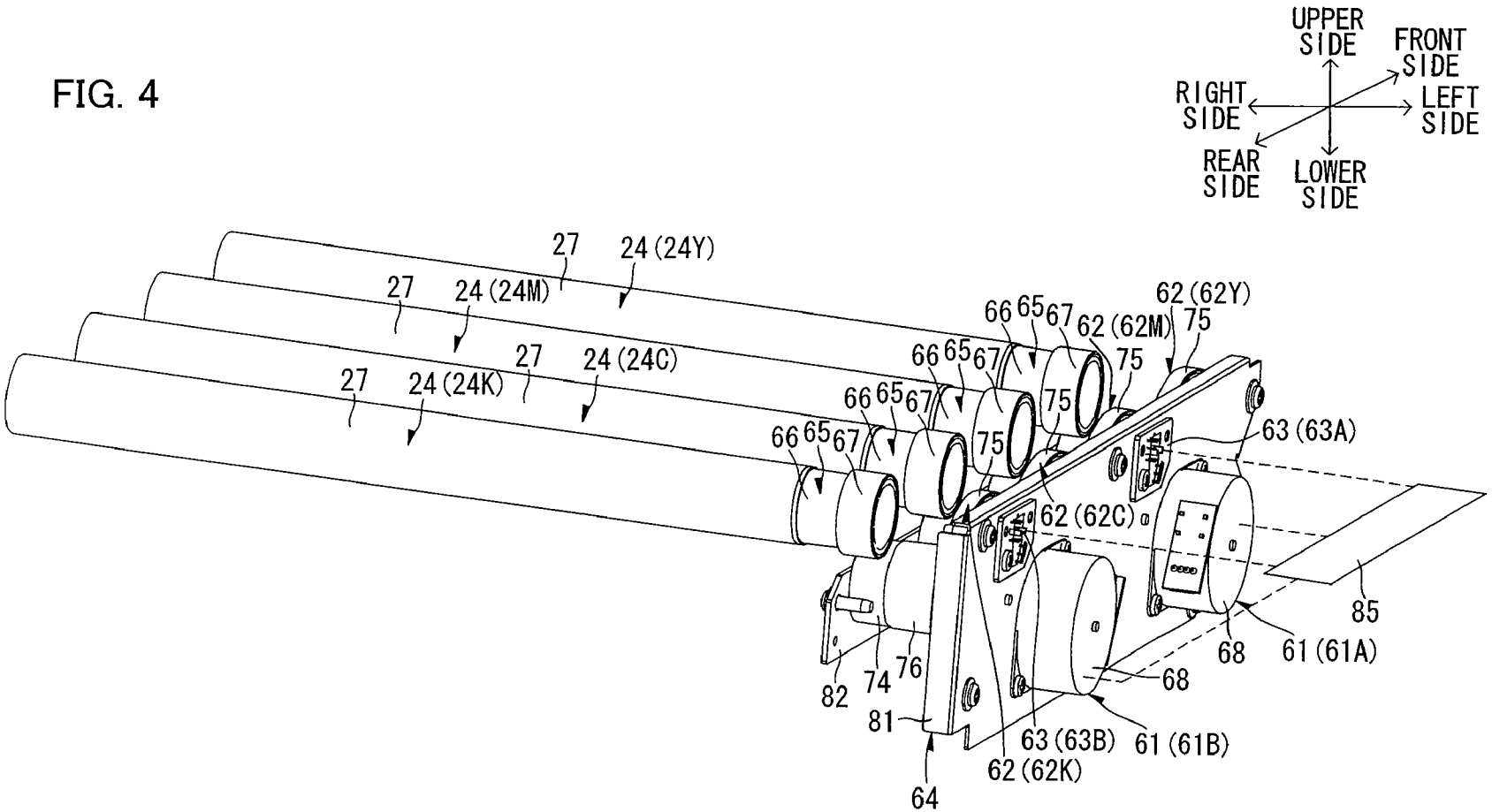
FIG. 4 is a perspective view (with a support plate) on the left side corresponding to FIG. 2.
Figure 5:
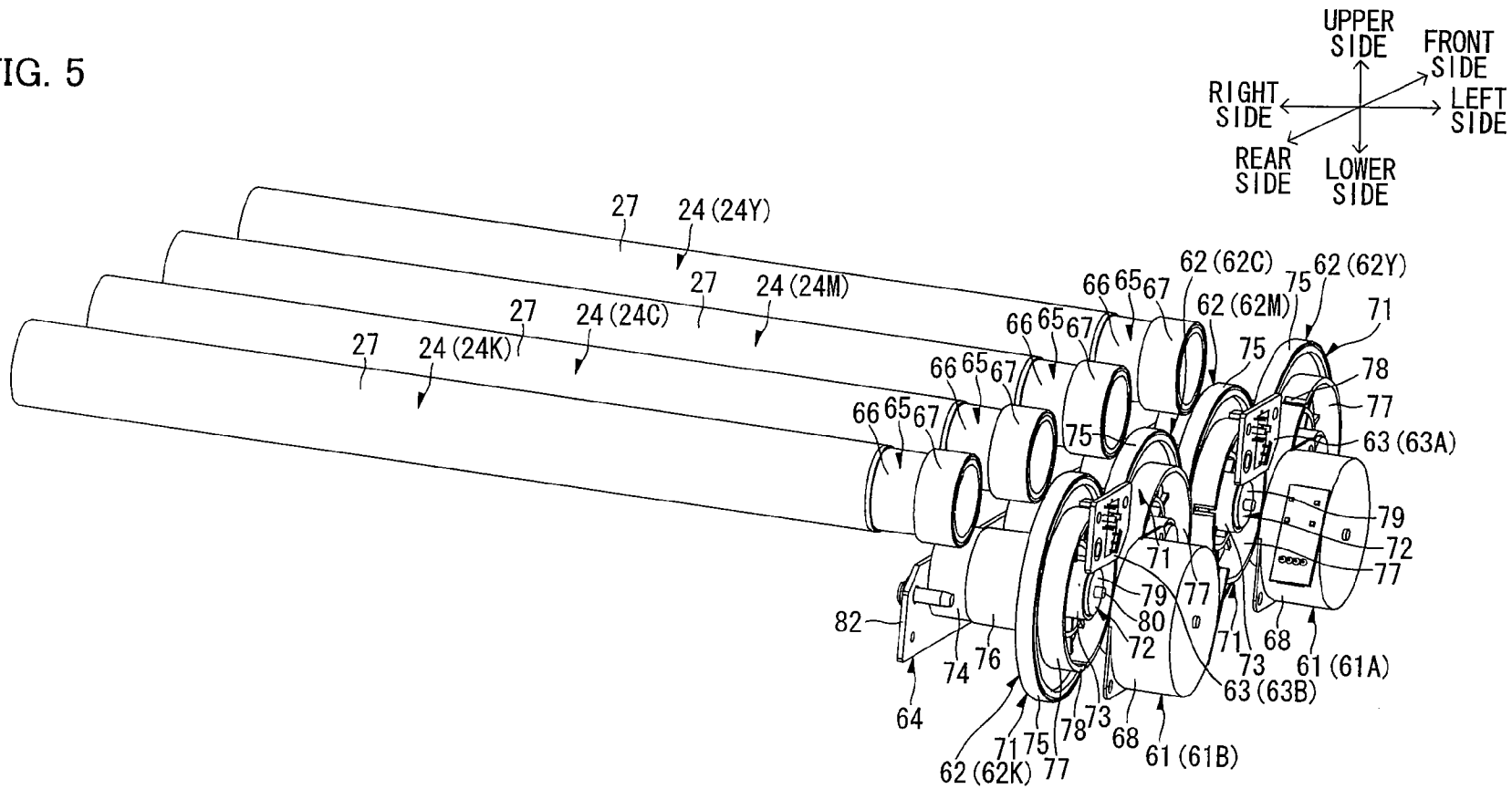
FIG. 5 is a perspective view (without the support plate) on the left side corresponding to FIG. 2.
Figure 6:
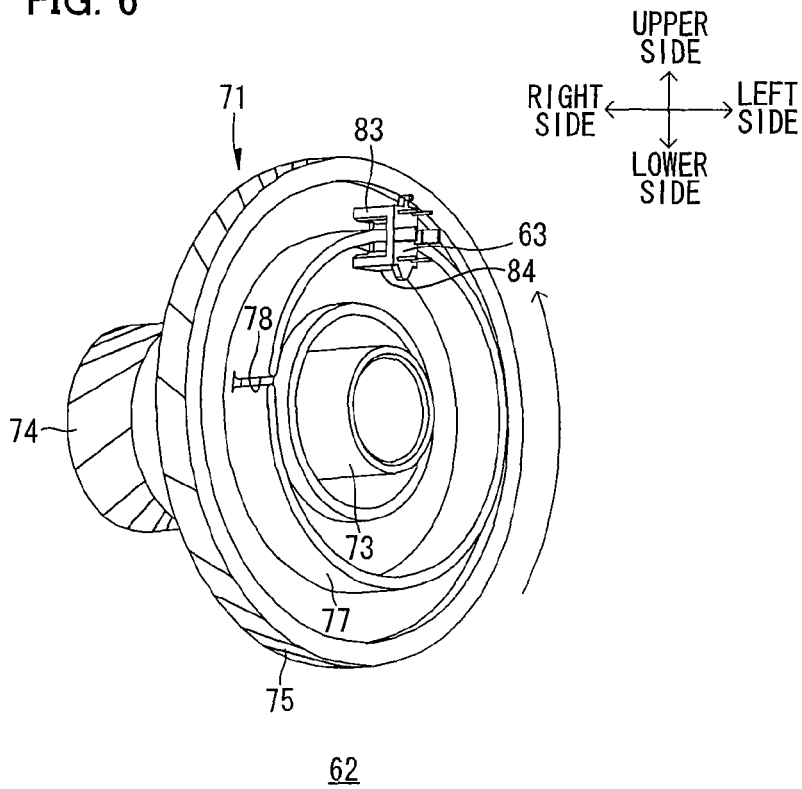
FIG. 6 is a perspective view on the left side of a transmission gear and a phase detecting sensor shown in FIG. 4.
Figure 7:
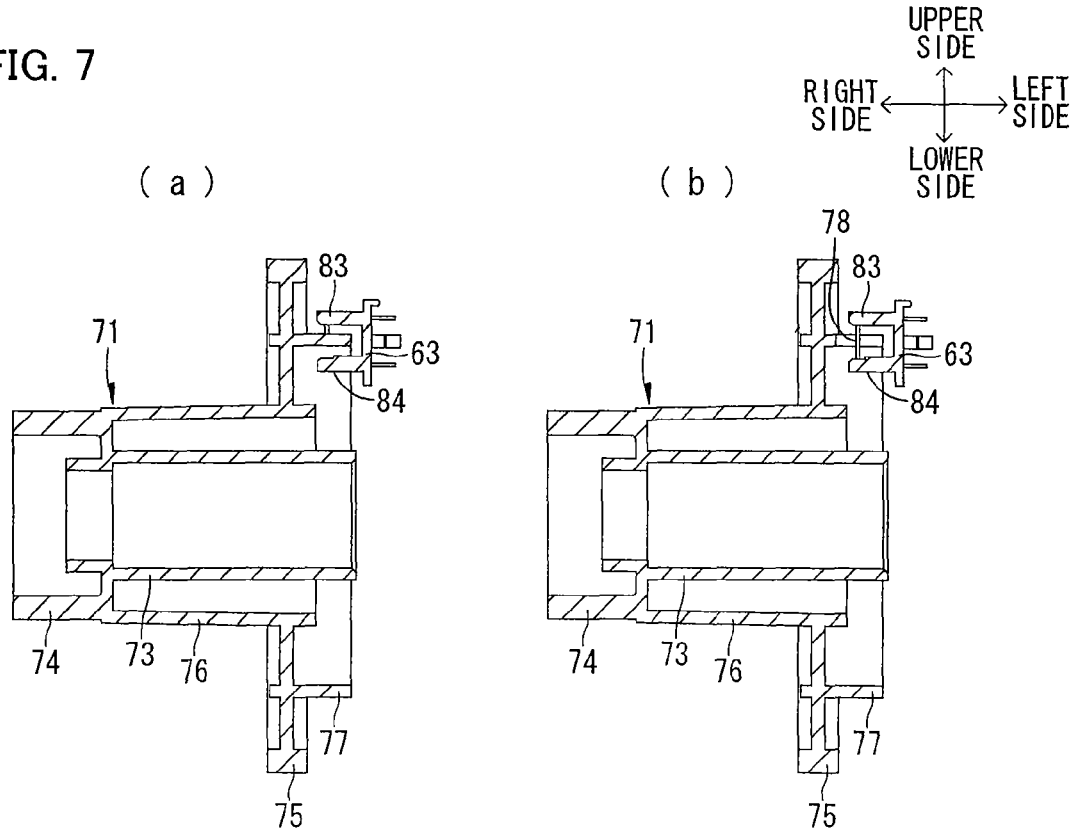
FIGS. 7(*a*) and 7(*b*) are explanatory views for explaining a method for detecting a phase of a transmission gear by a phase detecting sensor, wherein FIG. 7(*a*) shows a state where a slit is not detected and FIG. 7 (*b*) shows a state where the slit is detected.
Figure 8:
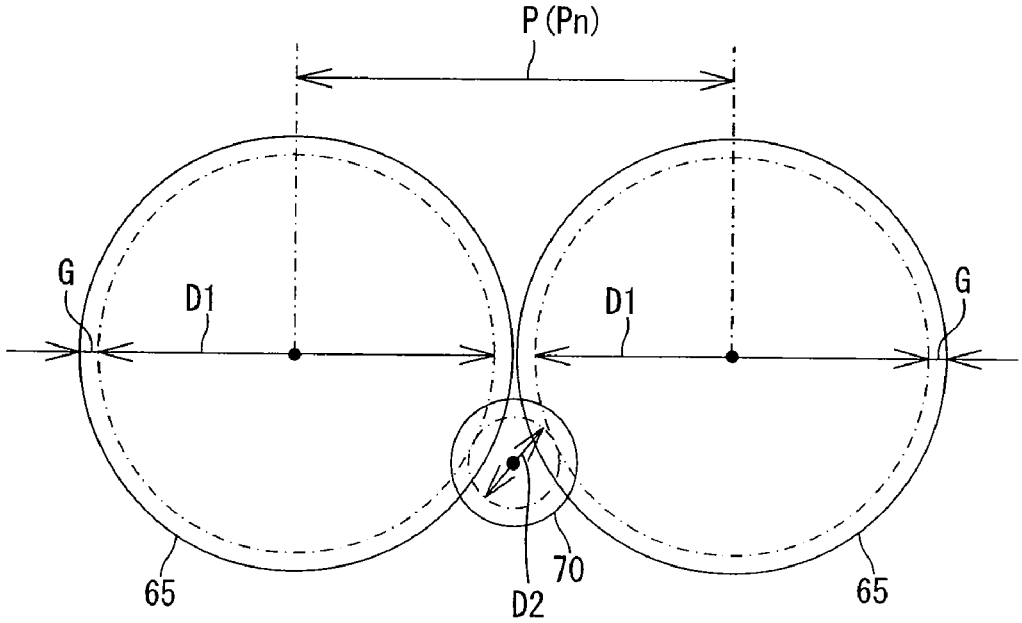
FIGS. 8(*a*) and 8(*b*) are explanatory views for explaining a relative arrangement between a pinion gear and the transmission gear.
Figure 8:
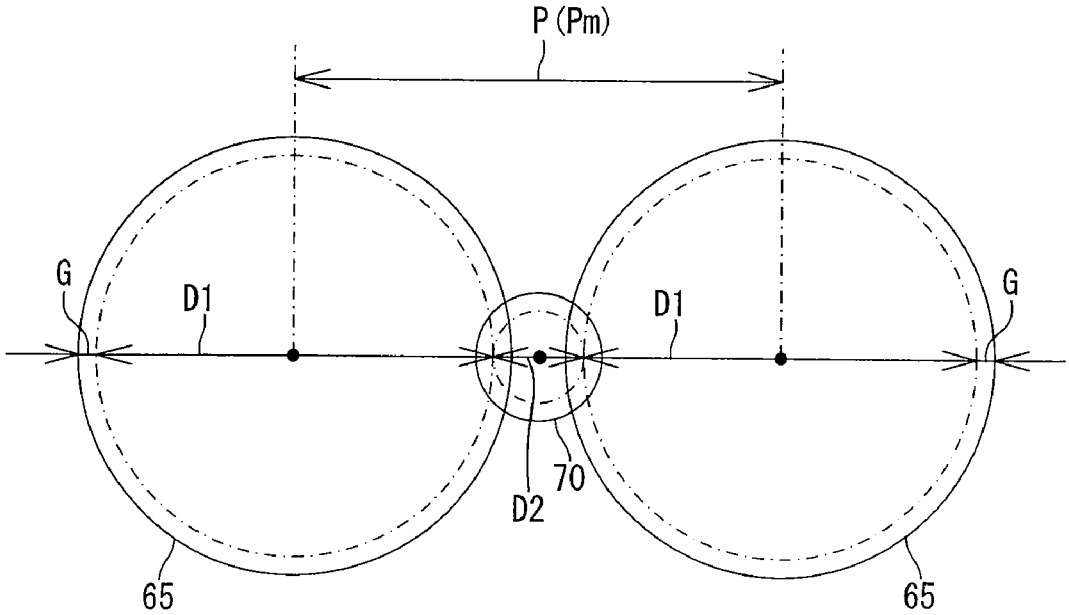
Figure 9:
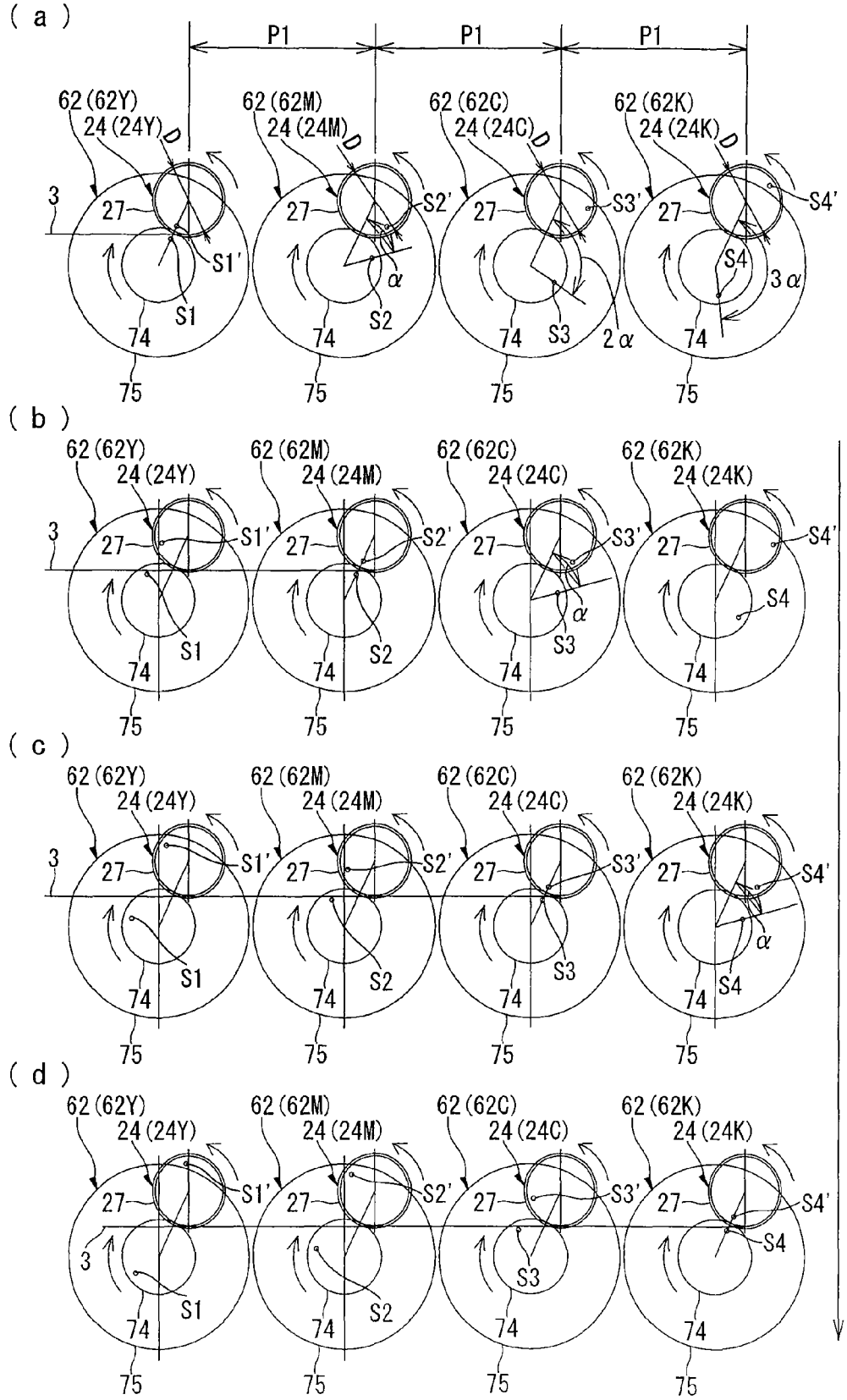
FIGS. 9(*a*) to 9(*d*) are explanatory views for explaining a phase of each of the transmission gears.

FIG. 2 is a plan view illustrating a major portion of the color laser printer shown in FIG. 1. FIG. 3 is a plan sectional view illustrating a major portion in FIG. 2. FIG. 4 is a left perspective view (with a support plate) corresponding to FIG. 2. FIG. 5 is a left perspective view (without the support plate) corresponding to FIG. 2. FIG. 6 is a left perspective view of a transmission gear and the phase detecting sensor shown in FIG. 4. FIGS. 7(*a*) and 7(*b*) are explanatory views for explaining a method for detecting a phase of a transmission gear by the phase detecting sensor, wherein FIG. 7(*a*) shows a state where a slit is not detected and FIG. 7 (*b*) shows a state where a slit is detected. FIGS. 8(*a*) and 8(*b*) are explanatory views for explaining a relative arrangement between a pinion gear and the transmission gear. FIGS. 9(*a*) to 9(*d*) are explanatory views for explaining phases of the respective transmission gears.

Next, with reference to FIGS. 2 through 9, a drive system of the photosensitive drum will be described in greater detail.

As shown in FIGS. 2 and 4 and mentioned hereinabove, this color laser printer 1 includes four photosensitive drums 24 (hereinafter, referred to as a yellow photosensitive drum 24Y, a magenta photosensitive drum 24M, a cyan photosensitive drum 24C and a black photosensitive drum 24K, respectively, according to the respective colors, in the case where each of the photosensitive drums 24 should be distinguished from each other).

Further, this color laser printer 1 includes four rotation support members 65 each provided corresponding to each of the four photosensitive drums 24.

Furthermore, this color laser printer 1 includes four transmission gears 62 each provided corresponding to each of drum gears 67 (later described) of the four rotation support members 65 and each meshed with each drum gear 67 (hereinafter, referred to as a yellow transmission gear 62Y, a magenta transmission gear 62M, a cyan transmission gear 62C and a black transmission gear 62K, respectively, according to the respective colors, in the case where each of the transmission gears 62 should be distinguished from each other).

Further, this color laser printer 1 includes two motors 61 each provided corresponding to a pair of the transmission gears 62 adjacent to each other and driving both of the pair of transmission gears 62.

Further, this color laser printer 1 includes two phase detecting sensors 63 provided corresponding to the two motors 61, and a common support plate 64 which supports the aforementioned two motors 61, four transmission gears 62 and two phase detecting sensors 63.

The support plate 64 is disposed along an anteroposterior direction on the left side of the transferring section 19 in the main body casing 2. The support plate 64 includes a left side plate 81 which is disposed at the left side of each drum gear 67 to be later described and a right side plate 82 which is provided on the right side in a spaced relation of the left side plate 81 and disposed below each drum gear 67 to be later described. These left side plate 81 and the right side plate 82 are opposed in a spaced relation in a width direction (lateral direction) and in a parallel relation along an anteroposterior direction.

The photosensitive drums 24 are disposed in an equidistantly spaced relation with each other in an anteroposterior direction and provided along a width direction. Each of the photosensitive drums 24 includes the drum body 27 and the drum shaft 28 as mentioned above.

Each of the rotation support members 65 is provided at the left end portion of the drum body 27 corresponding to each of the photosensitive drums 24.

Each of the rotation support members 65 integrally comprises a support cylinder 66 which is in a cylindrical shape and fitted into the left end portion of each drum body 27 in a relatively non-rotatable manner, and a drum gear 67 as an image carrier gear provided at the left end portion of each of the support cylinders 66.

Each of the rotation support members 65 is formed of a hard resin and is formed in the same molding die for integral formation of the support cylinder 66 and the drum gear 67.

Each of the support cylinders 66 is supported by the drum shaft 28 of each of the photosensitive drums 24 in a relatively rotatable manner, although not shown. Each of the drum gears 67 is in the form of a helical gear having substantially the same diameter as each of the drum body 27.

The transmission gears 62 are disposed in an equidistantly spaced relation with each other on the same straight line along an anteroposterior direction. More specifically, the yellow transmission gear 62Y, the magenta transmission gear 62M, the cyan transmission gear 62C, and the black transmission gear 62K are sequentially disposed in this order from the front to the rear.

Each of the transmission gears 62 includes a gear portion 71 and a support shaft 72 which supports the gear portion 71 as shown in FIG. 3.

The gear portion 71 integrally comprises a cylinder portion 76, a shaft insertion portion 73 provided in an axial direction in the cylinder portion 76, an inner gear 74 disposed on the right side of the cylinder portion 76, an outer gear 75 disposed on the left side of the cylinder portion 76, and a phase detected portion 77 provided on the left side of the outer gear 74, as shown in FIG. 7.

The cylinder portion 76 is in a cylindrical shape and disposed along a width direction (lateral direction) as shown in FIG. 2 and FIG. 3.

The shaft insertion portion 73 is in a cylindrical shape smaller in size than that of the cylinder portion 76 and disposed along an axial direction (width direction) of the cylinder portion 76 in the cylinder portion 76 as shown in FIG. 7. The right end portion of the shaft insertion portion 73 is connected to the right end portion of the cylinder portion 76.

The inner gear 74 is in the form of a cylindrical helical gear having substantially the same diameter as the cylinder portion 76 and provided so as to extend rightward from the right end portion the cylinder portion 76.

The outer gear 75 is in the form of a disk shaped helical gear having greater diameter than the cylinder portion 76, and provided so as to extend radially outward from the left end portion of the cylinder portion 76.

The phase detected portion 77 is in the form of a ring shape smaller in size than the outer gear 74 and larger than the cylinder portion 76, and disposed so as to extend leftward from the left side surface of the outer gear 74 as shown in FIGS. 6 and 7. The phase detected portion 77 is provided with an elongated slit 78 as a reference phase portion notched in a width direction at a specific position thereof in the circumferential direction from the left side end portion (free end portion) toward the vicinity of the right side end portion (proximal edge).

Additionally, the gear portion 71 of each of the transmission gears 62 is formed of a hard resin and is formed in the same molding die for integral formation of the cylinder portion 76, the shaft portion 73, the inner gear 74, the outer gear 75, and the phase detected portion 77 (including the slit 78).

The support shaft 72 integrally comprises a cylindrical support portion 79 which is inserted into the shaft insertion portion 73 of the gear portion 71, and pin portions 80 which extend outward in the width direction from the both end portions in the width direction of the support portion 79, as shown in FIG. 3. Each pin portion 80 is smaller in diameter than the support portion 79 and disposed along an axis of rotation of the support shaft 72.

Additionally, the support shaft 72 of each of the transmission gears 62 is formed of a hard resin and is formed in the same molding die for integral formation of the support portion 79 and the pin portion 80.

In each of the transmission gears 62, the pin portions 80 are fixed to the left side plate 81 and the right side plate 82, respectively, thereby holding the support shaft 72 along the width direction between the left side plate 81 and the right side plate 82.

In addition, in each of the transmission gears 62, the shaft insertion portion 73 fits over the support shaft 72 which is held between the left side plate 81 and the right side plate 82, thereby rotatably supporting the gear portion 71 by the support shaft 72.

With this configuration, each of the transmission gears 62 is rotatably supported between the left side plate 81 and the right side plate 82 such that the inner gear 74 is disposed in an opposed relation to the right side plate 82 in a manner that the inner gear 74 faces the right side plate 82, and such that the phase detected portion 77 is disposed in an opposed relation with the left side plate 81 in a manner that the phase detected portion 77 faces the left side plate 81.

In addition, the inner gear 74 of each of the transmission gears 62 is meshed from above with the drum gear 67 which is provided in each of the photosensitive drums 24.

The motor 61 includes a first motor 61A for driving a pair of front side transmission gears 62 (that is, the yellow transmission gear 62Y and the magenta transmission gear 62M) and a second motor 61B for driving a pair of rear side transmission gears (that is, the cyan transmission gear 62C and the black transmission gear 62K) as shown in FIGS. 2 and 4.

The first motor 61A and the second motor 61B are disposed in a spaced relation with each other on the same straight line along an anteroposterior direction. The first motor 61A is disposed on the front side and between the yellow transmission gear 62Y and the magenta transmission gear 62M in the anteroposterior direction. The second motor 61B is disposed on the rear side and between the cyan transmission gear 62C and the black transmission gear 62K in the anteroposterior direction. Both of the first motor 61A and the second motor 61B are supported by the left side plate 81.

Each of the motors 61 includes a disc-shaped motor body 68, a drive shaft 69 which extends rightward from the center of the motor body 68, and a pinion gear 70 provided in non-rotatable manner on the drive shaft 69 as a drive gear.

The motor body 68 is fixed on the left side surface of the left side plate 81 by a screw. The left side plate 81 is formed with an insertion hole (not shown) so as to extend through the thick direction corresponding to the center of the motor body 68. The drive shaft 69 is disposed so as to be inserted through the insertion hole from the motor body 68 and extend rightward from the right side surface of the left side plate 81.

The pinion gear 70 is provided at the free end portion of the drive shaft 69 in a spaced relation from the right side surface of the left side plate 81 in the right direction.

The pinion gear 70 of each of the motors 61 is interposed between the outer gears 75 of the pair of transmission gears 62 and meshed with both of the outer gears 75. More specifically, the pinion gear 70 of the first motor 61A is interposed between the yellow transmission gear 62Y and the magenta transmission gear 62M and meshed with both of the outer gears 75, and the pinion gear 70 of the second motor 61B is interposed between the cyan transmission gear 62C and the black transmission gear 62K and meshed with both of the outer gears 75.

In addition, in this color laser printer 1, a distance P between the rotation centers of the outer gears 75 of the pair of transmission gears 62 with respect to the pinion gear 70 of each of the motors 61 is set within a range shown in the following formula (1), as shown in FIG. 8.

$$D1+2G<P\leqq D1+D2 \quad (1)$$

where

D1 is a pitch circle diameter of the outer gear;

D2 is a pitch circle diameter of the pinion gear; and

G is an addendum of the outer gear.

That is, as shown in FIG. 8(*a*), in the pair of the transmission gears 62, the minimum distance Pn between the rotation centers of the outer gears 75 is set to be greater than a value D1+2G. The pitch circle diameter D1 is a value in which pitch circle radiuses (each D1/2) of the two outer gears 75 are added to each other, and 2G is a value in which the addendums G of the two outer gears 75 are added to each other. That is, the minimum distance Pn between the rotation centers of the outer gears 75 is Pn>D1+2G.

On the other hand, in the pair of the transmission gears 62, the maximum distance Pm between the rotation centers of the outer gears 75 is set to be equal or smaller than a value D1+D2. The pitch circle diameter D1 is a value in which pitch circle radiuses (each D1/2) of the two outer gears 75 are added to each other, and D2 represents the pitch circle diameter of the pinion gear 70. That is, the maximum distance Pm between the rotation centers of the outer gears 75 is Pm≦D1+D2.

Based upon this, the distance P between the rotation centers of the outer gears 75 of the pair of transmission gears 62 with respect to the pinion gear 70 of each of the motors 61 is set within the range shown in the above formula (1).

In the above formula (1), the ratio (D1/D2) of pitch circle diameter D1 of the outer gear 75 with respect to the pitch circle diameter D2 of the pinion gear 70 is set such that D1 is 5 times or more of D2, for example, or preferably, that D1 is 10 times or more of D2. When the ratio of the pitch circle diameter D1 of the outer gear 75 with respect to the pitch circle diameter D2 of the pinion gear 70 is set to the above-mentioned value, the gear ratio of the outer gear 75 with respect to the pinion gear 70 can be greater and the driving force from the motor 61 can be smoothly transmitted.

In addition, in this color laser printer 1, as shown in FIG. 9, in the pair of transmission gears 62 (that is, the yellow transmission gear 62Y and the magenta transmission gear 62M, or the cyan transmission gear 62C and the black transmission gear 62K), a phase of one outer gear 75 is set as a reference phase and a phase of the other outer gear 75 is positioned by a rotation angle α° with respect to the reference phase shown in the below formula (2).

$$\alpha°=(P1\pi D)/\pi D\times 360° \quad (2)$$

where

P1 is a distance between the rotation centers of the drum bodies of the respective photosensitive drums; and D is a diameter of the image carrier.

That is, when the circumference of a circle πD of the drum body 27 is subtracted from the distance P1 between the rotation centers of the drum bodies 27 in the pair of photosensitive drums 24, the remaining distance after one rotation cycle of the drum bodies 27 can be obtained. Then, the remaining distance is divided by the circumference of the circle πD of the drum body 27. The obtained value is then multiplied by 360°. This provides a shift angle (rotation angle) of the drum bodies 27 corresponding to the remaining distance.

The phase of the one outer gear 75 is set as a reference phase, and when the other phase of the outer gear 75 is shifted with respect to this reference phase by aforementioned shift angle (rotation angle) α+, the phases of the outer gears 75 of the pair of transmission gears 62 can have a uniform phase with respect to the sheet 3.

In this color laser printer 1, the phase of the outer gear 75 of the magenta transmission gear 62M is disposed so as to be shifted by the aforementioned shift angle (rotation angle) α° with the phase of the outer gear 75 of the yellow transmission gear 62Y as the reference phase as shown in FIG. 9(*a*).

More specifically, the outer gear 75 of the yellow transmission gear 62Y is disposed and a reference phase point S1 (corresponding to the slit 78, for example) of the outer gear 75 of the yellow transmission gear 62Y is set corresponding to a contact point S1' of the drum body 27 of the yellow photosensitive drum 24Y which makes first contact with the transported sheet 3.

Because the outer gear 75 of the yellow transmission gear 62Y and the outer gear 75 of the magenta transmission gear 62M are formed in the same molding die as mentioned above, a reference phase point S2 (corresponding to the slit 78, for example), of the outer gear 75 of the magenta transmission gear 62M, corresponding to the reference phase point S1 of the outer gear 75 of the yellow transmission gear 62Y is set. Then the outer gear 75 of the magenta transmission gear 62M is disposed such that the reference phase point S2 is shifted by α° with the reference phase point S1 being set as a reference (0°).

When the outer gear 75 of the magenta transmission gear 62M is disposed so as to be shifted by α°, the phase of the magenta photosensitive drum 24M is also shifted by α° with respect to the phase of the yellow photosensitive drum 24Y.

In case where the outer gear 75 of the magenta transmission gear 62M with respect to the outer gear 75 of the yellow transmission gear 62Y is disposed as described above, when the sheet 3 is transported to the magenta photosensitive drum 24M through the yellow photosensitive drum 24Y as shown in FIG. 9(*b*), the phase of the reference phase point S2 of the outer gear 75 of the magenta transmission gear 62M reaches the phase of the reference phase point S1 (0°) of the yellow transmission gear 62Y as shown in FIG. 9(*a*). At this time, the contact point S2' of the drum body 27 of the magenta photosensitive drum 24M corresponding to the contact point S1' of the drum body 27 of the yellow photosensitive drum 24Y makes first contact with the sheet 3. This can synchronize the phases of the pair of transmission gears 62, that is, the yellow transmission gear 62Y and the magenta transmission gear 62M with respect to the sheet 3.

In this color laser printer 1, as in the same manner described above, the phase of the outer gear 75 of the black transmission gear 62K is disposed so as to be shifted by aforementioned shift angle (rotation angle) α° with the phase of the outer gear 75 of the cyan transmission gear 62C as a reference phase as shown in FIG. 9(*c*).

With this arrangement, when the sheet 3 is transported to the black photosensitive drum 24K through the cyan photosensitive drum 24C, as shown in FIG. 9(*d*), the phase of a reference phase point S4 of the outer gear 75 of the black transmission gear 62K reaches the phase of a reference phase point S3 (0°) of the cyan transmission gear 62C shown in FIG. 9(*c*). At this time, a contact point S4' of the drum body 27 of the black photosensitive drum 24K corresponding to the contact point S3' of the drum body 27 of the cyan photosensitive drum 24C makes first contact with the sheet 3. This can synchronize the phases of the pair of transmission gears 62, that is, the cyan transmission gear 62C and the black transmission gear 62K with respect to the sheet 3.

The two phase detecting sensors 63 are provided corresponding to the pair of transmission gears 62 corresponding to the two motors 61 as shown in FIGS. 4 and 5.

The phase detecting sensor 63 includes a first phase detecting sensor 63A which is provided corresponding to the pair of transmission gears 62 on the front side (that is, the yellow transmission gear 62Y and the magenta transmission gear 62M) and a second phase detecting sensor 63B which is provided corresponding to the pair of transmission gears 62 on the rear side (that is, the cyan transmission gear 62C and the black transmission gear 62K).

The first phase detecting sensor 63A and the second phase detecting sensor 63B are disposed in a spaced relation with each other on the same straight line along an anteroposterior direction. The first phase detecting sensor 63A is disposed on the front side and is in an opposed relation to the magenta transmission gear 62M in the width direction. The second phase detecting sensor 63B is disposed on the rear side and is in an opposed relation to the black transmission gear 62K in the width direction. Both the first phase detecting sensor 63A and the second phase detecting sensor 63B are supported on the left side plate 81.

Each of the phase detecting sensors 63 is an optical sensor in a flat bottomed U-shape in cross section and includes a light emitting portion 83 and a light receiving portion 84 which are disposed in an opposed spaced relation with each other in an up-and-down direction, as shown in FIGS. 6 and 7.

In each of the phase detecting sensors 63, the light emitting portion 83 and the light receiving portion 84 are supported on the left side plate 81 so as to sandwich between above and below the phase detected portions 77 of the transmission gears 62 which oppose thereto in a width direction.

In each of the phase detecting sensors 63, the light emitting portion 83 and the light receiving portion 84 oppose in an up-and-down direction to the phase detected portions 77 of the transmission gears 62 which oppose thereto in a width direction at all times during image formation. In the phase detected portion 77 while rotating, when the light emitting portion 83 and the light receiving portion 84 are not in an opposed relation to the slit 78, the detection light traveling from the light emitting portion 83 toward the light receiving portion 84 is blocked, as shown in FIG. 7(*a*). On the other hand, when the light emitting portion 83 and the light receiving portion 84 are in an opposed relation to the slit 78, the detection light is transmitted, as shown in FIG. 7(*b*).

Each of the phase detecting sensors 63 detects the phases of the outer gears 75 of the transmission gears 62 opposing thereto in a width direction by detecting the timing (pulse interval) of receiving the detection light which is transmitted through the slit 78.

More specifically, the first phase detecting sensor 63A detects the phase of the outer gear 75 of the magenta transmission gear 62M which opposes thereto in a width direction and the second phase detecting sensor 63B detects the phase of the outer gear 75 of the black transmission gear 62M which opposes thereto in a width direction.

Each of the phase detecting sensor 63 is connected to a CPU 85 (see FIG. 4) provided in the main body casing 2 as a control unit. The CPU 85 is connected to each of the motors 61. The CPU 85 controls each of the motors 61 on the basis of the detection results of the phase of the outer gear 75 of each of the transmission gears 62 detected by each of the detecting sensors 63.

More specifically, the CPU 85 controls the first motor 61A and the second motor 61B on the basis of the detection results of the phase of the outer gear 75 of the magenta transmission gear 62M and the phase of the outer gear 75 of the black transmission gear 62M detected by the first phase detecting sensor 63A and the second phase detecting sensor 63B. More details will be shown below.

First, the first phase detecting sensor 63A detects the phase of the outer gear 75 of the magenta transmission gear 62M and inputs the detection signal to the CPU 85. The second phase detecting sensor 63B detects the phase of the outer gear 75 of the black transmission gear 62M and inputs the detection signal to the CPU 85.

Then, the CPU 85 controls the first motor 61A and the second motor 61B so that the outer gear 75 of the magenta transmission gear 62M is set as a reference phase, and the phase of the outer gear 75 of the black transmission gear 62M is shifted by twice the rotation angle $\alpha°$ expressed in the aforementioned formula (2) with respect to the reference phase set above, as shown in FIG. 9.

Consequently, with the outer gear 75 of the yellow transmission gear 62Y being set as a reference phase, the phase of the outer gear 75 of the magenta transmission gear 62M shifts by $\alpha$ times, the phase of the outer gear 75 of the cyan transmission gear 62C shifts by 2 $\alpha$ times, the phase of the outer gear 75 of the black transmission gear 62K shifts by 3 $\alpha$ times. As a result, the four transmission gears 62 can have a uniform phase with respect to the sheet 3.

In other words, in this laser printer 1, the phases are uniform with respect to the sheet 3 between the outer gears 75 of the pair of transmission gears 62 (that is, between the outer gear 75 of the yellow transmission gear 62Y and the outer gear 75 of the magenta transmission gear 62M, and between the outer gear 75 of the cyan transmission gear 62C and the outer gear 75 of the black transmission gear 62K), as described above. Accordingly, the phase of the outer gear 75 of the one transmission gear 62 (that is, the magenta transmission gear 62M) in one pair of the transmission gears 62 (that is, the yellow transmission gear 62Y and the magenta transmission gear 62M) and the phase of the outer gear 75 of the one transmission gear 62 (that is, the black transmission gear 62) in the other pair of the transmission gears 62 (that is, the cyan transmission gear 62C and the black transmission gear 62K) are set to the same amount whereby all the four outer gears 75 of the transmission gears 62 have the same phase.

More specifically, when the sheet 3 is transported to the cyan photosensitive drum 24C through the magenta photosensitive drum 24M, as shown in FIG. 9(*c*), the phase of the reference phase point S3 of the outer gear 75 of the cyan transmission gear 62C reaches the phase of the reference phase point S2 (0°) of the magenta transmission gear 62M shown in FIG. 9(*b*). At this time, the contact point S3' of the drum body 27 of the cyan photosensitive drum 24C corresponding to the contact point S2' of the drum body 27 of the magenta photosensitive drum 24M makes first contact with the sheet 3. This can synchronize the phase of the outer gear 75 of the magenta transmission gear 62M and the cyan transmission gear 62C with respect to the sheet 3. In this manner, as shown in FIGS. 9(*a*) through 9(*d*), all the four outer gears 75 of the transmission gears 62 can have the same phase.

The CPU 85 achieves the above-mentioned controls by controlling the rotation speeds of the first motor 61A and the second motor 61B.

In addition, each of the motors 61 is controlled such that the phase of the outer gear 75 of the black transmission gear 62K shifts by twice the rotation angle α° with the phase of the outer gear 75 of the magenta transmission gear 62M being set as the reference phase.

Alternatively, each of the motors 61 may be controlled such that the phase of the outer gear 75 of the magenta transmission gear 62M shifts by twice the rotation angle α° with the phase of the outer gear 75 of the black transmission gear 62K being set as the reference phase.

Further, the disposition of each of the phase detecting sensor 63 may be changed appropriately to control each of the motors 61 such that, for example, the phase of the outer gear 75 of the cyan transmission gear 62C may shift by twice the rotation angle α° with the phase of the outer gear 75 of the yellow transmission gear 62Y being set as the reference phase. Further, each of the motors 61 may be controlled such that the phase of the outer gear 75 of the black transmission gear 62K shifts by three times the rotation angle α° with the phase of the outer gear 75 of the yellow transmission gear 62Y being set as the reference phase.

3. Operational Effects of Photosensitive Drum Drive System

As described above, in this color laser printer 1, the two motors 61 (the first motor 61A and the second motor 61B) drive the pair of transmission gears 62 (a pair of the yellow transmission gear 62Y and the magenta transmission gear 62M, a pair of the cyan transmission gear 62C and the black transmission gear 62K), respectively. With this, the four transmission gears 62 drive the corresponding four drum gears 67, and as a result, all of the four drum gears 67 are driven. Because the four photosensitive drums 24 can thus be driven by the two motors 61, the configuration can be made simpler and the cost can be reduced.

Further, the numbers of the gears can be reduced because only the drum gear 67 and the transmission gear 62 are interposed respectively between each of the motors 61 and the two photosensitive drums 24 which are driven corresponding to each of the motors 61 (that is, the yellow photosensitive drum 24Y and the magenta photosensitive drum 24M driven corresponding to the first motor 61A, and the cyan photosensitive drum 24C and the black photosensitive drum 24K driven corresponding to the second motor 61B). As a result, the gear transmission error can be reduced to reduce the printing error. In addition, the number of the gear can be reduced to reduce the space for the gear, and the device can be made smaller.

Further, in this color laser printer 1, the four rotation support members 65 and the four transmission gears 62 are formed in the same molding die respectively. This can reduce the errors between each of the drum gears 67 and between each of the transmission gears 62, and further reduce the gear transmission error to further reduce the printing error.

Furthermore, in this color laser printer 1, as described above, the distance P between the rotation centers of the outer gears 75 of the pair of the transmission gears 62 with respect to the pinion gear 70 of each of the motors 61 is set within the range shown in the above formula (1).

Therefore, while the pair of outer gears 75 can be formed greater than the pinion gear 70 and a greater gear ratio can be achieved therebetween, an arrangement of the pair of transmission gear 62 to the pinion gear 70 can be made compact. Accordingly, while the pinion gear 70 can smoothly transmit the driving force to the pair of outer gears 75 with the greater gear ratio, the device can be made compact.

Furthermore, in this color laser printer 1, as described above, the phase of the one outer gear 75 of the pair of transmission gears 62 is set as a reference phase, and with respect to this reference phase, the phase of the other outer gear 75 is disposed so as to be shifted by the rotation angle α° as expressed in the aforementioned formula (2).

With this, the phase of the both outer gears 75 can be synchronized with respect to the motor 61. Accordingly, this simple configuration, in which the rotation angle is shifted, can reliably prevent the color shift between the photosensitive drums 24 corresponding to both of transmission gears 62.

Furthermore, in this color laser printer 1, as described above, the CPU 85 controls each of the motors 61 such that the phases of the pair of transmission gears 62 are synchronized on the basis of the detection results from the corresponding phase detecting sensor 63.

More specifically, the CPU 85 controls the first motor 61A and the second motor 61B such that, with the phase of the outer gear 75 of the magenta transmission gear 62M being set as the reference phase, the phase of the outer gear 75 of the black transmission gear 62K shifts by twice the rotation angle α° with respect to this reference phase.

With this, the phases of the transmission gears 62 can be synchronized between the pair of transmission gears 62 (that is, the pair of the yellow transmission gear 62Y and the magenta transmission gear 62M, and the pair of the cyan transmission gear 62C and the black transmission gear 62K). As a result, all the four transmission gears 62 can have a uniform phase. Accordingly, this simple control, in which only the rotation angles are shifted, can reliably prevent the color shifts of the photosensitive drums 24 among all the transmission gears 62.

Furthermore, in this color laser printer 1, an accurate relative disposition among components can be achieved since all the transmission gears 62, all the motors 61 and all the phase detecting sensors 63 are supported on the common left side plate 81. This can further reduce the error between the drum gears 67 and between the transmission gears 62. Reduction of the gear transmission error can achieve further reduction of the printing error.

In addition, each of the transmission gears 62 is rotatably supported on the left side plate 81. The magenta transmission gear 62M and the black transmission gear 62M are provided with the phase detected portion 77, which faces the left side plate 81. The phase detected portion 77 is formed with the slit 78. The first phase detecting sensor 63A and the second phase detecting sensor 63B are supported by the left side plate 81 so that the light emitting portion 83 and the light receiving portion 84 can oppose the respective slits 78 of the phase detected portions 77 of the magenta transmission gear 62M and the black transmission gear 62M.

Accordingly, the slit 78 of each phase detected portion 77 is detected by the first phase detecting sensor 63A or the second phase detecting sensor 63B between the magenta transmission gear 62M or the black transmission gear 62M and the left side plate 81. This can achieve an accurate detection of the slit 78 of each phase detected portion 77 by each phase detecting sensor 63.

4. Modification

In the above-mentioned embodiment, although the drum unit 21 is provided separately from the drum subunit 23 such that the developer cartridge 22 which corresponds to each color can be removably mounted to each drum subunit 23 which corresponds to each color, the developer cartridge 22 and the drum subunit 23 can be integrally formed. In this case, when the drum unit 21 is replaced, the toner, the developing roller 34 and the photosensitive drum 24 which correspond to each color can also be replaced at the same time.

Further, in the above-mentioned embodiment, although the tandem color laser printer 1, which directly transfers an image from each of the photosensitive drums 24 onto the sheet 3 is illustrated, the present invention should not be limited thereto. Alternatively, the present invention may be configured as, for example, an intermediate transport type color laser printer in which the toner images for respective colors are transferred from respective photosensitive bodies to an intermediate transport body temporarily and then transferred onto the sheet all together.

The embodiments described above are illustrative and explanatory of the invention. The foregoing disclosure is not intended to be precisely followed to limit the present invention. Various modifications and alterations are possible in light of the foregoing description, and may be obtained by implementing the invention. The present embodiments are selected and described for explaining the essence and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

four image carriers;

four image carrier gears corresponding to the respective image carriers;

four transmission gears corresponding to and meshed with the respective image carrier gears; and two driving sources, each corresponding to a pair of the transmission gears being adjacent to each other, for driving each pair of transmission gears, two phase detection units corresponding to the respective pairs of transmission gears for detecting a phase of at least one of the pair of transmission gears; and a control unit for controlling the respective driving sources on the basis of detection results of the respective phase detection units, wherein in each pair of transmission gears, with a phase of one transmission gear being set as a reference phase, a phase of the other transmission gear is provided so as to shift with respect to the reference phase by a rotation angle α° as expressed by the following formula (2):

$$\alpha^\circ=(P1-\pi D)/\pi D\times 360^\circ \quad (2)$$

where

P1 is a distance between centers of the image carriers being adjacent to each other; and D is a diameter of the image carrier.

2. The image forming apparatus according to claim 1, wherein, the four image carrier gears are formed in a same molding die, and the four transmission gears are molded in a same molding die.

3. The image forming apparatus according to claim 1, wherein, each of the driving sources includes a drive gear meshing with each pair of transmission gears, and a distance P between centers of the pair of transmission gears is expressed by the following formula (1):

$$D1+2G<P\leqq D1+D2 \quad (1)$$

where

D1 is a pitch circle diameter of the transmission gear;

D2 is a pitch circle diameter of the drive gear; and

G is an addendum of the transmission gear.

4. The image forming apparatus according to claim 1, wherein the apparatus comprises a common support plate for supporting all the transmission gears, all the driving sources, and all the phase detection units.

5. The image forming apparatus according to claim 1, comprising:

an image carrier unit integrally holding the four image carriers and the four image carrier gears, wherein the image carrier unit is removably mounted to a body of the image forming apparatus, and the transmission gears are held by the body of the image forming apparatus.

6. An image forming apparatus comprising:

four image carriers;

four image carrier gears corresponding to the respective image carriers;

four transmission gears corresponding to and meshed with the respective image carrier gears; and two driving sources, each corresponding to a pair of the transmission gears being adjacent to each other, for driving each pair of transmission gears, two phase detection units corresponding to the respective pairs of transmission gears for detecting a phase of at least one of the pair of transmission gears; and a control unit for controlling the respective driving sources on the basis of detection results of the respective phase detection units, wherein the control unit controls the respective driving sources such that, on the basis of detection results of the respective phase detection units, with a phase of one of the transmission gears in one of the pairs of transmission gears being set as a reference phase, a phase of one of the transmission gears in the other pair of the transmission gears is shifted with respect to the reference phase by an integral multiple of a rotation angle α° as expressed by the following formula (2):

$$\alpha^\circ=(P1-\pi D)/\pi D\times 360^\circ \quad (2)$$

where

P1 is a distance between the centers of the image carriers being adjacent to each other; and D is a diameter of the image carrier.

7. An image forming apparatus comprising:

four image carriers;

four image carrier gears corresponding to the respective image carriers;

four transmission gears corresponding to and meshed with the respective image carrier gears; and two driving sources, each corresponding to a pair of the transmission gears being adjacent to each other, for driving each pair of transmission gears, two phase detection units corresponding to the respective pairs of transmission gears for detecting a phase of at least one of the pair of transmission gears; a control unit for controlling the respective driving sources on the basis of detection results of the respective phase detection units; and a common support plate for supporting all the transmission gears, all the driving sources, and all the phase detection units, wherein all the transmission gears are rotatably supported on the support plate;

one of the transmission gears in the pair of the transmission gears is provided with a reference phase portion for being detected by the phase detection unit such that the reference phase portion faces the support plate; and the phase detection units are supported on the support plate in opposition to the respective reference phase portions.

8. An image forming apparatus comprising:

four image carriers;

four image carrier gears corresponding to the respective image carriers;

four transmission gears corresponding to and meshed with the respective image carrier gears;

two driving sources, each corresponding to a pair of the transmission gears being adjacent to each other, for driving each pair of transmission gears, wherein, in each pair of transmission gears, with a phase of one transmission gear being set as a reference phase, a phase of the other transmission gear is provided so as to shift with respect to the reference phase by a rotation angle α° as expressed by the following formula (2):

$$\alpha^\circ=(P1-\pi D)/\pi D\times 360^\circ \quad (2)$$

where

P1 is a distance between centers of the image carriers being adjacent to each other; and D is a diameter of the image carrier.

9. The image forming apparatus according to claim 8, comprising:

two phase detection units corresponding to the respective pairs of transmission gears for detecting a phase of at least one of the pair of transmission gears; and a control unit for controlling the respective driving sources on the basis of detection results of the respective phase detection units.

10. The image forming apparatus according to claim 9, wherein, the control unit controls the respective driving sources such that, on the basis of detection results of the respective phase detection units, with a phase of one of the transmission gears in one of the pairs of transmission gears being set as a reference phase, a phase of one of the transmission gears in the other pair of the transmission gears is shifted with respect to the reference phase by an integral multiple of a rotation angle α° as expressed by the following formula (2):

$$\alpha^\circ=(P1-\pi D)/\pi D\times 360^\circ \quad (2)$$

where

P1 is a distance between the centers of the image carriers being adjacent to each other; and D is a diameter of the image carrier.

11. The image forming apparatus according to claim 9, wherein, the apparatus comprises a common support plate for supporting all the transmission gears, all the driving sources, and all the phase detection units.

12. The image forming apparatus according to claim 11, wherein, all the transmission gears are rotatably supported on the support plate;

one of the transmission gears in the pair of the transmission gears is provided with a reference phase portion for being detected by the phase detection unit such that the reference phase portion faces the support plate; and the phase detection units are supported on the support plate in opposition to the respective reference phase portions.

13. The image forming apparatus according to claim 8, wherein, the four image carrier gears are formed in a same molding die, and the four transmission gears are molded in a same molding die.

14. The image forming apparatus according to claim 8, wherein, each of the driving sources includes a drive gear meshing with each pair of transmission gears, and a distance P between centers of the pair of transmission gears is expressed by the following formula (1):

$$D1+2G<P\leqq D1+D2 \quad (1)$$

where

D1 is a pitch circle diameter of the transmission gear;

D2 is a pitch circle diameter of the drive gear; and

G is an addendum of the transmission gear.

15. The image forming apparatus according to claim 8, comprising:

an image carrier unit integrally holding the four image carriers and the four image carrier gears, wherein the image carrier unit is removably mounted to a body of the image forming apparatus, and the transmission gears are held by the body of the image forming apparatus.

* * * * *